United States Patent [19]

Garza

[11] Patent Number: 4,911,476

[45] Date of Patent: Mar. 27, 1990

[54] INFORMATION PAD FOR CHECKBOOKS

[76] Inventor: Raul G. Garza, 12 Ollerton, Conroe, Tex. 77303

[21] Appl. No.: 331,834

[22] Filed: Apr. 3, 1989

[51] Int. Cl.[4] ..... B43L 1/12; B42D 3/00

[52] U.S. Cl. ..... 281/29; 283/58; 283/64.1; 434/410

[58] Field of Search ..... 281/15.1, 29, 31, 35, 281/39; 283/57, 58, 63.1, 64.1; 150/135; 434/410

[56] References Cited

U.S. PATENT DOCUMENTS

| | | | |
|---|---|---|---|
| 1,455,579 | 5/1923 | Evans . | |
| 2,359,195 | 9/1944 | Berliner et al. . | |
| 2,475,698 | 7/1949 | Croker . | |
| 2,663,095 | 12/1953 | Chase . | |
| 2,697,884 | 12/1954 | Dechert . | |
| 2,879,609 | 3/1959 | Watkins . | |
| 3,152,406 | 10/1964 | Marques . | |
| 3,435,543 | 4/1969 | Slemmons | 283/574 |
| 3,579,871 | 5/1971 | Eddington . | |
| 4,566,721 | 1/1986 | Friedman et al. | 281/31 |
| 4,589,685 | 5/1986 | Lazar | 283/81 |

*Primary Examiner*—Douglas D. Watts

*Assistant Examiner*—Eugenia A. Jones

*Attorney, Agent, or Firm*—Harrison & Egbert

[57] ABSTRACT

An information pad for checkbooks that comprises a checkbook cover having flexible material, and an information receiving pad that is flexibly fastened to an edge of the checkbook cover. The checkbook cover is a type that has a suitable slot for receiving checkbooks. The information receiving pad has a size less than the area of the checkbook cover. The information receiving pad includes an impression layer, a flexible translucent adhering sheet, a flexible transparent sheet, and a slip coating. The impression layer has a first planar surface and a second planar surface. The first planar surface has a black waxy coating for recording written information. The flexible translucent adhering sheet overlies the first planar surface of the impression layer. The flexible transparent sheet overlies the flexible translucent adhering sheet. This transparent sheet is in surface-to-surface contact with the adhering sheet during the receiving of written information. A hinge member extends between the edge of the impression layer and the edge of the checkbook cover so as to allow the information receiving pad to be folded within the cover.

20 Claims, 4 Drawing Sheets

INFORMATION PAD FOR CHECKBOOKS

TECHNICAL FIELD

The present invention relates to checkbooks. More particularly, the present invention relates to checkbooks having magic slates attached thereto. Additionally, the present invention relates to magic slates.

BACKGROUND ART

In present checkbooks, it is often difficult to carry out computations, record information, and otherwise balance the checkbook without having an adjacent sheet of paper. Many times, checkbook users must conduct mathematical computations in the margins surrounding checkbooks, or in the ledger portion of checkbooks. Beyond the unsightly appearance of such margin calculations, these additional markings can create problems for banks and other persons that would process such checks. The appearance of these unsightly calculations within the ledger sheet could confuse the user and cause miscalculations in balancing one's checkbook.

Many present day checkbooks incorporate a calculator within the checkbook cover. Although this aids in the computation of various matters associated with checking activities, calculators are cumbersome and will not record a variety of information. In addition, calculators cannot be easily folded or stuffed into one's pocket haphazardly. Many times, calculators will run out of power, or will become defective with use. The use of calculators in conjunction with checkbooks is a costly endeavor by the checkbook manufacturer and is generally found to be unsuitable for consumer use.

Reusable erasable memo pads have been widely known and are primarily used in toys and novelties. Such pads are called "magic slates" and generally comprise a clay, putty, or wax impression surface which is impregnated with an oil and is overlaid with a translucent sheet, see U.S. Pat. No. 1,455,579. A pointed instrument similar to a pencil is used to apply pressure to the translucent sheet and the sheet adheres to the impression surface creating a visible mark on the translucent sheet. This mark can be erased by lifting the translucent sheet away from the impression surface thereby breaking the adhesion and erasing the sheet.

Although "magic slates" have been principally used in toys, other more utilitarian uses have been considered. Generally, these uses have been directed to memo pads and record books wherein temporary notations must be jotted down, see U.S. Pat. Nos. 2,198,095, 2,663,095, 2,997,884 and 3,579,871. "Magic slates" have been used in switchboard message pads, wherein a single impression surface and a plurality of translucent sheets are secured to a mounting plate which is mounted over the switchboard, see U.S. Pat. No. 2,818,662. Transparent protective sheets are usually provided to overlay the translucent sheet and protect the recorded indicia.

Simplified erasure means have also been proposed which simplify the erasure process. Some erasure means comprise slides which can be moved between the translucent sheet and the impression surface to separate the sheet from the surface erasing recorded indicia, see U.S. Pat. No. 4,011,665. Such slide erasure means can be used to control individual translucent sheets independently of adjacent translucent sheets thereby providing independent erasure pads, as illustrated in U.S. Pat. No. 2,894,336. Another form of erasure means is a pneumatically operated system wherein an air blast is used to separate the translucent sheet from the impression surface, see U.S. Pat. Nos. 3,943,643 and 4,051,609. U.S. Pat. Nos. 1,181,140, 2,359,195 and 2,404,563, disclose erasure means in which the impression surface is pulled away from the adhering indicia-bearing sheets.

The difficulty with using magic slates in conjunction with checkbooks is the difficulty of providing a stylus for use by the checkbook user. Typically, the checkbook user will have a pen in hand so as to properly write the check and record the check information. If a separate stylus were provided, then the checkbook user would be unlikely to use the stylus. As a result, the "magic slate" would soon be destroyed by the constant use of ball point pens and the smearing of ink across the magic slate. It is believed unlikely that the checkbook user would resort to using the stylus, in place of pen-in-hand, because of the difficulty of manipulation. It is believed that a stylus would easily become lost.

There is also an additional difficulty in incorporating a magic slate into a checkbook. It is often difficult to find the space in which to incorporate the "magic slate". Also, the magic slate must be positioned so that the marking of the ledger or the marking of checks would not transmit this written information to the magic slate. Furthermore, it is desirable to store the magic slate such that the recorded information will not become erased by the separation of the translucent sheet from the impression layer. As such, the positioning of the magic slate, and the method of attaching the magic slate to the checkbook, is an important consideration.

It is an object of the present invention to provide an information pad for use in conjunction with a checkbook.

It is another object of the present invention to provide an information pad that resists residual ball point pen ink remnants.

It is another object of the present invention to provide an information pad that is attached to the checkbook in an optimum manner.

It is still a further object of the present invention to provide an information pad that is relatively inexpensive, easy to manufacturer, flexible, and easily utilized.

These and other objects and advantages of the present invention will become apparent from a reading of the attached specification and appended claims.

SUMMARY OF THE INVENTION

The present invention is an information pad for checkbooks. This invention comprises a checkbook cover of flexible material and an information receiving pad hat is flexibly fastened to an edge of the checkbook cover. The checkbook cover includes suitable means for receiving checkbooks therein. The information receiving pad serves to erasably receive written information. This information receiving pad has a size less than the area of the checkbook cover so as to allow the information pad to be folded into the checkbook cover. This information receiving pad comprises, in particular, an impression layer having a first planar surface and a second planar surface, a flexible translucent adhering sheet that overlays the first planar surface of the impression layer, and a flexible transparent sheet that overlies the adhering sheet. The first planar surface of the impression layer defines the surface for recording written information. This first planar surface has a black waxy coating thereacross. The second planar surface is of a generally flat cardboard material. The cardboard material should be sufficiently rigid so as to allow written information to be impressed onto the information pad.

The flexible translucent adhering sheet is a sheet of polyvinyl chloride material. This translucent adhering sheet is of a type that will partially adhere to the black waxy surface of the first planar surface whenever written information is imparted thereupon. When the adhering sheet is separated from the black waxy surface, the written information (or written indicia) disappears.

The flexible transparent sheet is in generally surface-to-surface contact with the adhering sheet during the receiving of written information by the impression layer. A slip material is spread across the surface of the transparent layer opposite the adhering sheet. This slip material serves to prevent ink from ballpoint pens from residing on the surface of the transparent layer. As used herein, the term "slip material" is a material that is strongly resistant to ink transmission from ballpoint pens.

The information receiving pad is seam welded to an edge of the inner plastic sleeve of the checkbook. Specifically, a hinge member extends between the edge of the impression layer of the information receiving pad and the edge of the checkbook cover. This hinge member causes the information receiving pad to be foldable into the inner side of the checkbook cover. In particular, the hinge member is fixedly fastened to the second planar surface of the impression layer.

The impression layer, the flexible translucent adhering sheet, and the flexible transparent sheet are aligned and connected along the longitudinal edge of the information receiving pad. However, the adhering sheet and the transparent sheet extend beyond the other longitudinal edge of the impression layer.

In an alternative embodiment, the information receiving pad is provided with an adhesive strip located on the opposite side of the hinge member from the second planar planar surface of the impression layer. This adhesive strip allows the information receiving pad to be suitably attached in hinged relationship to the edge of the checkbook cover.

DETAILED DESCRIPTION OF THE INVENTION

Figure 1:
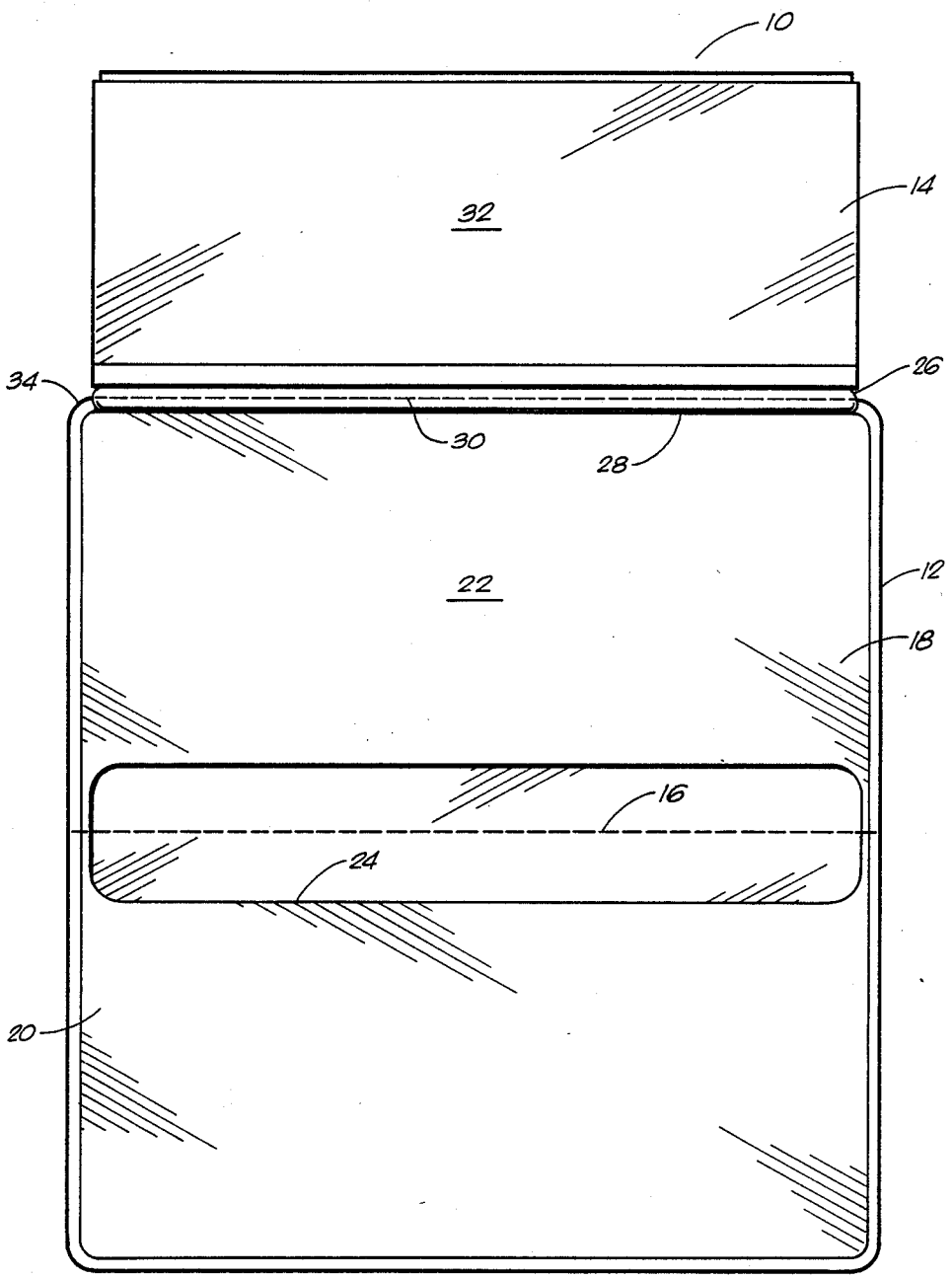
FIG. 1 is a frontal view of the information pad for checkbooks in accordance with the preferred embodiment of the present invention.

Referring to FIG. 1, there is shown at 10, the information pad for checkbooks in accordance with the preferred embodiment of the present invention. In particular, the information pad at 10 comprises a checkbook cover 12 and the information receiving pad 14.

The checkbook cover 12 is typically comprised of a plastic material. Although the checkbook cover as illustrated at 12 is of plastic material, it i also possible for the checkbook cover 12 to be made of vinyl or leather. The choice of materials for checkbook cover 12 is simply a matter of design choice and is not intended to be a limitation on the present invention. The important limitation as to checkbook cover 12 is that the checkbook cover be of a flexible material suitable for folding. Ideally, the checkbook cover 12 should be of the type suitable for folding and placing in one's pocket. The checkbook cover 12 includes a fold portion 16. Fold portion 16 may be an indentation, as illustrated in FIG. 1, or a form in the cover itself. The purpose of the fold portion 16 is to allow checkbook half 18 to be folded over and onto checkbook half 20. The checkbook cover 12 also includes an inner plastic sleeve 22 that is fastened to the inner side of the cover 12. This inner plastic sleeve 22 has a slot 24 that extends thereacross. Slot 24 serves to receive the back cover of a checkbook. In operation, a single checkbook may be placed onto slot 24 by sliding the back cover of the checkbook into the area between the checkbook cover 12 (the backing) and the inner plastic sleeve 22. As such, the checkbook will be retained in the area of checkbook half 20. To close the checkbook, the checkbook half 18 is folded across fold portion 16 and over the top of the checkbook residing in slot 24.

The information receiving pad 14 includes a hinge member 26 that extends between the information receiving pad 14 and the checkbook cover 12. This hinge member is seam welded at 28 to an edge of the inner plastic sleeve 22 within checkbook 12. The dotted line illustrated at 30 illustrates the perforation, or fold portion, of hinge member 26. By utilizing this fold portion 30, the information receiving pad 14 may be folded downwardly toward the checkbook half 18 and received therein. The checkbook half 18 may be utilized to receive the checkbook ledger, receipts, or other information pertinent to the checking operation.

Figure 3:
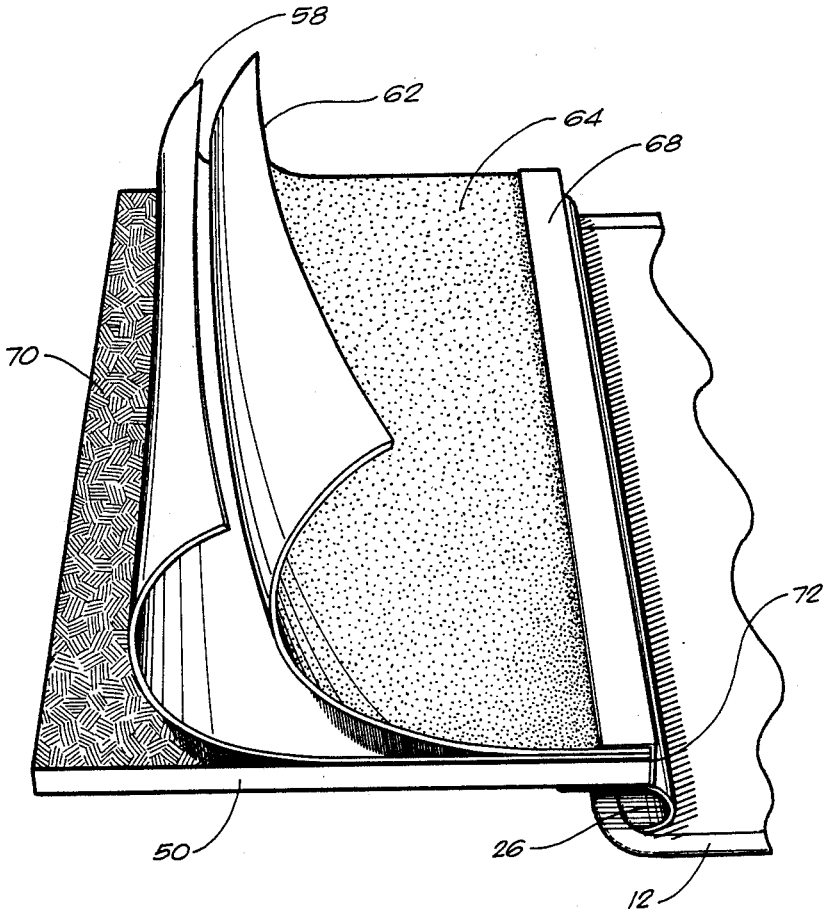
FIG. 3 is an isolated view, in perspective, of the information pad as separated from the checkbook.

The information receiving pad 14 is shown in particular detail in FIG. 3. Relative to FIG. 1, it can be seen that the writing surface 32 is facing outwardly. When the checkbook is unfolded, writing area 32 openly presents itself to the user when the information receiving pad 14 is folded outwardly. As such, the user of the checkbook can conduct calculations on the information receiving pad 14 by simply using the same pen as utilized to conduct the checking procedure. In addition, it can be seen, in FIG. 1, that the information receiving pad is extended outwardly beyond the upper edge 34 of the checkbook cover 12. This places the information receiving pad 14 in a convenient location for the checkbook user's use. In this arrangement, the pad 14 does not, in any way, interfere with the process of writing a check, recording a check, or balancing the checkbook. In addition, the information receiving pad 14 may be refolded into the checkbook cover 12 so as to mark a proper location within the ledger.

Figure 2:
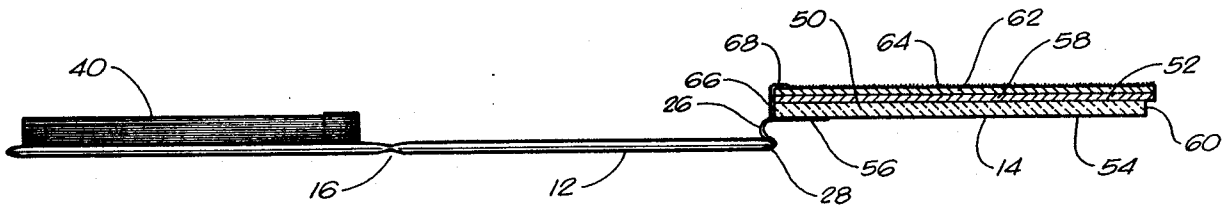
FIG. 2 is a side view, in expanded portion, of the information pad for checkbooks in accordance with the preferred embodiment of the present invention.

Referring to FIG. 2, there is shown a side view, in rather exaggerated proportion, of the checkbook cover 12, the information receiving pad 14, and checkbook 40. In FIG. 2, the checkbook cover 12 has a fold portion 16 roughly in the center of the checkbook. The checkbook 40 is shown as inserted into the slot 24. Checkbook 40 is a standard checkbook having a plurality of individual checks contained therein.

Of more importance in FIG. 2 is the configuration of the information receiving pad 14. The information receiving pad is flexibly fastened by way of the hinge member 26 to the end 28 of the checkbook cover 12. It can be seen that the hinge member 26 is seam welded to the checkbook cover 12. Hinge member 26 curves outwardly from the point of attachment and then back inwardly. The hinge member 26 is flexible enough to allow the easy movement and folding of the information receiving pad 14 into the area of the checkbook cover 12. The information receiving pad 14 serves the purpose of erasably receiving written information. Importantly, the information receiving pad should have a size less than the surface area of the checkbook cover 12. The information receiving pad 14 includes an impression layer 50 that has a first planar surface 52 and a second planar surface 54. The first planar surface 52, at the top of the impression layer 50, is a surface for recording written information. The impression layer 50 is generally a rigid planar member. The first planar surface 52 is a black waxy coating. Alternatively, a clay, putty, or wax impression surface which is impregnated with an oil is suitable for the first planar surface 52 of the impression layer 50. Typically, the impression layer 50 is made up of a solid cardboard material.

Hinge member 26 has a portion 56 that is fixedly fastened to the end surface of the second planar surface 54.

Overlying the first planar surface 52 of the impression layer 50 is a flexible translucent adhering sheet 58. This adhering sheet 58 is typically made of a polyvinyl chloride-type material. As can be seen in FIG. 2, the adhering sheet 58 has a length that extends outwardly beyond the end 60 of the impression layer 50. It is important that the end of adhering sheet 58 extend outwardly a small distance beyond the end 60 so that the user can conveniently lift the adhering sheet 58 from first planar surface 52. The adhering sheet 58 has a surface that adheres to the black waxy coating on the first planar surface 52 of impression layer 50 in the presence of a written impression. This adherence will cause the production of visible indicia. The visible indicia disappears upon the separation of the adhering sheet 58 from the black waxy coating on the first planar surface 52 of impression layer 50. The separation may occur by lifting the and of adhering sheet 58 from impression layer 50.

A flexible transparent sheet 62 overlays the adhering sheet 58 opposite the impression layer 50. This transparent sheet 62 is in surface-to-surface contact with the adhering sheet 58 during the receiving of written information by the impression layer 50. This transparent sheet 62 is made of a MYLAR (TM) material. As shown in FIG. 2 (and also in FIG. 1), the transparent sheet 62 has a surface area that is generally equal to that of the adhering sheet 58. In operation, the purpose of the transparent sheet 62 is to prevent the loss of recorded information on the adhering sheet 58. In addition, it serves to prevent damage to the adhering sheet 58.

Importantly, a slip material 64 is coated upon the outer surface of the transparent sheet 62. Slip material 68 may be an animal fat, a waxy surface, or an extrusion coating. These materials are resistant to ink transmission from ballpoint pens. The coating may be done by heating the slip material 68 and applying a coating evenly over the top surface of transparent sheet 62. The focus of the slip material 64 is to resist the transmission of ink from ball point pins. In other "magic slates", continual use of the magic slate results in a deteriorating appearance of the exterior sheet and a residual impression of ink transmission upon the sheet. Since it is very easy to cause these ink deposits to reside on the transparent sheet, many developers of magic slates accompany the slates with a stylus. The stylus was often cumbersome, kept in an inconvenient location, or otherwise difficult to use. By incorporating the slip material on the surface of the transparent layer 62, the checkbook user can utilize the same pen used to record information in the ledger or used to write the check. Very little or no ink deposits will reside on the transparent sheet 62 when the slip material is incorporated. The use of the slip material also keeps the ink deposits from residing on the exterior surface of the magic slate and subsequent transfer onto clothes, checks, or other locations.

It can be seen in FIG. 2 that the longitudinal edges 66 of the transparent sheet 62, the adhering sheet 58, and the impression layer 50 are aligned. A wrap 68 covers this longitudinal edge 66 so as to maintain each of the sheets and layers in proper position relative to each other. Wrap 68 may be attached to the end of the sheets by gluing, welding, or other adhesive attachment. In this configuration, it is easy to lift the adhering sheet 58 from the first planar surface 52 of the impression layer 50.

FIG. 3 is a detailed view showing the arrangement of the sheets. In FIG. 3, the black waxy coating 70 is placed on the first planar surface of the impression layer 50. The adhering sheet 58 is shown as overlying the black waxy coating 70 on the impression layer 50. The transparent sheet 62 then overlies the translucent adhering sheet 58 such that the translucent sheet 58 is sandwiched between the transparent sheet 52 and the impression layer 50. The slip material 64 covers the outer surface of the transparent sheet 62. The wrap material 68 is shown as maintaining the ends 72 of each of the sheets and layers in alignment. In this configuration, it can be seen that the sheets may be easily lifted without removal. The hinge area 26 extends downwardly from the wrap 68 for engagement with the checkbook cover 12.

Figure 4:
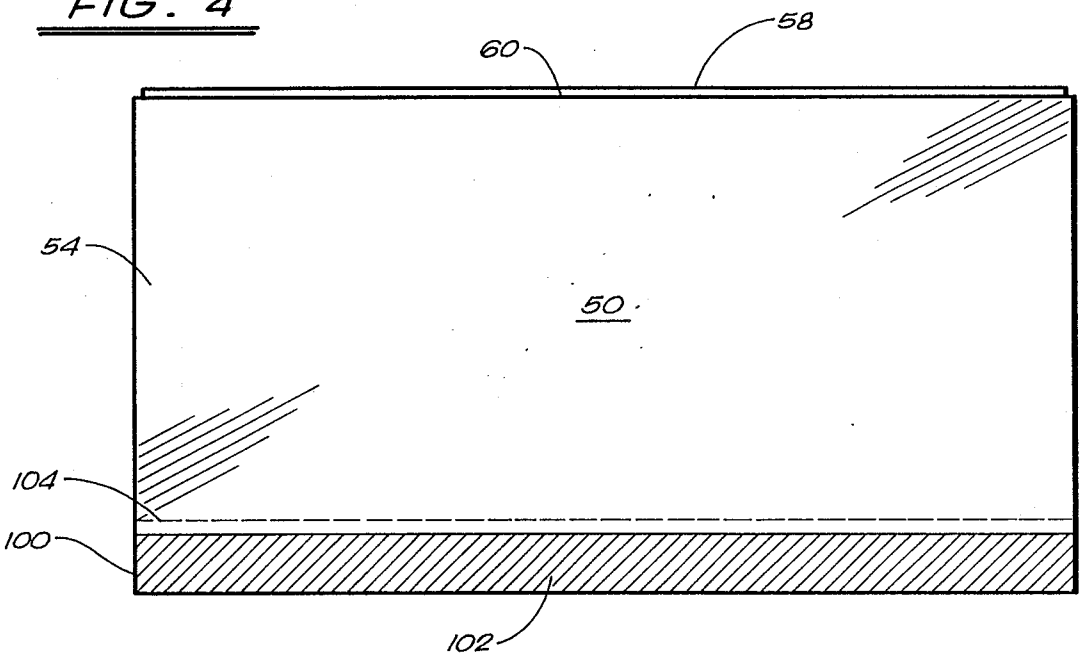
FIG. 4 is a rearward view of the information pad in the alternative embodiment of the present invention.

FIG. 4 is a rearward view showing an alternative embodiment of the present invention. With reference to FIG. 4, it can be seen that the information receiving pad 14 includes a flexible adhesive section 100. The flexible adhesive section 100 is fastened to the second planar surface 54 of the impression layer 50. An adhesive strip 102 extends outwardly from this impression layer. The adhesive strip 102 is for selectively fastening the information receiving pad 14 to an edge of a foldable checkbook. Various types of adhesives may make up the adhesive strip 102. Ideally, the adhesive that makes up the adhesive strip 102 should be the type that is covered with an outer protective paper. When the paper is removed, the adhesive becomes exposed and available for use. There is a foldable portion 104 that is suitable for allowing the information receiving pad 14 to be folded as indicated previously into the foldable checkbook. In the embodiment illustrated in FIG. 4, it can also be seen how the translucent layer 58 extends outwardly beyond the end 60 of the impression layer 50. The adhesive strip 102 is adjacent to the longitudinal edges 66 of the information receiving pad 14. The embodiment of FIG. 4 offers an alterative to seam welding or other integral fastening of the information receiving pad 14 to the checkbook. As such, the information receiving pad 14 may be separated from the checkbook itself and available for attachment and reattachment to various checkbook covers.

The present invention offers an improvement over the prior art in various ways. First, the present invention allows the magic slate concept to be used with checkbooks. As a result, calculations can be carried out on the magic slate, names recorded, dates recorded, and other vital information recorded without the need for note pads. The present invention allows an expedient way to erase this information and make the slate available for future recording. The positioning of the information receiving pad along an edge of the checkbook is quite beneficial. This keeps the pad 14 away from the checkbook ledger or the checkbook itself. It is maintained in a convenient location for use. The present invention also utilizes the unique concept of the slip material to keep the ink from ballpoint pens from residing on the surface of the transparent sheet. This is important so as to prevent smudging or other transmission of ink. It is also important insofar as a stylus is not required with the present invention.

As a further alternative, it should be noted that it is possible to utilize the slip material in conjunction with the translucent sheet 58. The transparent sheet 62 is not an absolute requirement of the information receiving pad 14. If the slip material were properly coated onto the outer surface of the translucent sheet 58, then the pad 14 would function properly. In this embodiment, however, information loss could possibly occur. Although this is not the preferable embodiment, it is an embodiment within the intentions of the present invention.

The embodiments as illustrated and discussed in this specification are intended only to teach those skilled in the art the best way known by the inventor to make and use the invention. Nothing in the specification should be considered as limiting the scope of the present invention. Many changes could be made by those skilled in the art to produce equivalent systems without departing from the invention. The present invention should only be limited by the following claims and their legal equivalents.

I claim:

1. An information pad for checkbooks comprising:

a checkbook cover of flexible material, said checkbook cover having means for receiving checkbooks therein; and information receiving means flexibly fastened to said checkbook cover, said information receiving means for erasably receiving written information, said information receiving means having a size less tan the area of said checkbook cover, said information receiving means comprising:

an impression layer having a first planar surface and a second planar surface, said first planar surface defining the surface for recording written information;

a flexible translucent adhering sheet overlaying said first planar surface of said impression layer; and a flexible transparent sheet overlaying said flexible translucent adhering sheet, said flexible transparent sheet in surface-to-surface contact with said flexible translucent adhering sheet during the receiving of written information by said impression layer, said flexible transparent sheet having a slip material coating on the surface opposite said flexible translucent adhering sheet.

2. The pad of claim 1, said checkbook cover comprised of a plastic material, said checkbook cover having a fold portion such that part of said cover may fold over another portion of said checkbook cover.

3. The pad of claim 2, said checkbook cover having an inner plastic sleeve fastened to the inner side of said cover, said inner plastic sleeve having a slot extending thereacross, said slot for receiving a portion of a checkbook.

4. The pad of claim 3, said information receiving means being seam welded o an edge of said inner plastic sleeve within said checkbook.

5. The pad of claim 3, said information receiving means further comprising:

a hinge member extending between an edge of said impression layer and an edge of said checkbook cover, said hinge member for causing said information receiving means to be foldable into the inner side of said checkbook cover.

6. The pad of claim 5, said hinge member being fixedly fastened to said second planar surface of said impression layer.

7. The pad of claim 1, said impression layer, said flexible translucent adhering sheet, and said flexible transparent sheet being connected along a longitudinal edge of said information receiving means.

8. The pad of claim 7, said flexible translucent adhering sheet and said impression layer being aligned along said longitudinal edge of said information receiving means, the other longitudinal edge of said flexible translucent adhering sheet extending beyond the longitudinal edge of said impression layer.

9. The pad of claim 1, said impression layer being a rigid planar member, said first planar surface having a black waxy coating.

10. The pad of claim 9, said impression layer having a solid cardboard backing.

11. The pad of claim 9, said flexible translucent adhering sheet having a surface adhering to said black waxy coating in the presence of a written impression so as to produce a visible indicia, said visible indicia disappearing upon the separation of said flexible translucent adhering sheet from said black waxy coating.

12. The pad of claim 1, said flexible translucent adhering sheet being a polyvinyl chloride material.

13. The pad of claim 1, said slip material of said flexible transparent sheet for resisting the transmission of ink from ball point pens.

14. The pad of claim 13, said flexible transparent sheet being a MYLAR (TM) material, said flexible transparent sheet having a surface area generally equal to that of said flexible translucent adhering sheet.

15. The pad of claim 1, said information receiving means being removably fastened to an edge of said checkbook cover, said second planar surface of said impression layer having an adhesive strip extending outwardly therefrom, said adhesive strip being flexible, said adhesive strip positioned outwardly beyond the longitudinal edge of said impression layer.

16. An information receiving impression slate for use on checkbooks comprising:

an impression layer having a first planar surface and a second planar surface, said first planar surface defining a surface for recording written information;

a flexible translucent adhering sheet overlying said first planar surface of said impression layer, said impression layer and said flexible translucent adhering sheet having a configuration such that said flexible translucent adhering sheet adheres to said impression layer in the presence of written impressions such that visible indicia of said written impressions appear;

a slip material overlying said flexible translucent adhering sheet, said slip material for resisting ink transmission from ball point pens; and a flexible adhesive section having a surface fastened to said second planar surface of said impression layer, said adhesive section having an adhesive surface extending outwardly from said impression layer, said adhesive surface for fastening said adhesive section to an edge of a checkbook.

17. The slate of claim 16, further comprising:

a flexible transparent sheet overlying said flexible translucent adhering sheet, said slip material covering said flexible transparent sheet opposite said flexible translucent adhering sheet.

18. The slate of claim 17, said impression layer, said flexible translucent adhering sheet, and said flexible transparent sheet connected together along the longitudinal edge of said impression layer adjacent said adhesive section.

19. The slate of claim 17, said first planar surface of said impression layer having a black waxy coating, said second planar surface of said impression layer being of cardboard material, said flexible translucent adhering sheet being of a polyvinyl chloride material, and said flexible transparent sheet being of MYLAR material.

20. The slate of claim 16, said flexible adhesive section being a flexible hinged material, said hinged material allowing said slate to be folded within said checkbook.

* * * * *